US005655762A

United States Patent [19]

Yergenson

[11] Patent Number: 5,655,762

[45] Date of Patent: Aug. 12, 1997

[54] MECHANISM FOR AVOIDING MULTIPLE SHEET MISFEEDS IN SHEET MEDIA FEED SYSTEMS

[75] Inventor: Robin P. Yergenson, Meridian, Id.

[73] Assignee: Hewlett-Packard Company, Palo Alto, Calif.

[21] Appl. No.: 518,776

[22] Filed: Aug. 24, 1995

[51] Int. Cl.[6] ..... B65H 3/52

[52] U.S. Cl. ..... 271/121; 271/124; 271/245

[58] Field of Search ..... 271/121, 122, 271/124, 244, 245, 902

[56] References Cited

U.S. PATENT DOCUMENTS 5,269,506 12/1993 Olson et al. ..... 271/121

5,316,285 5/1994 Olson et al. ..... 271/122

*Primary Examiner*—David H. Bollinger

[57] ABSTRACT

A clearing mechanism for use in stacked sheet media feeding systems of the type having a single sheet pick/feed mechanism for feeding a single sheet from the top of a sheet media stack. The clearing mechanism includes a "kick" lever positioned adjacent and somewhat below a sheet picking roller. At the beginning of the sheet feeding cycle, the lever is moved by a cam/follower from an obstructing position within the feed zone adjacent to the leading edge of the media stack to a non-obstructing position free of the feed zone for unobstructed feeding of the top sheet. After the leading edge of the top sheet has cleared the lever, the lever is urged by a spring force back toward the obstructing position. If the lever does not return to the obstructing position at the urging of the spring force, then, upon rotation of the pick/feed mechanism into a pre-sheet feeding orientation, a second cam/follower moves the lever into the obstructing position, thereby clearing any next-to-top sheets that may have inadvertently advanced partially into the feed zone.

20 Claims, 8 Drawing Sheets

MECHANISM FOR AVOIDING MULTIPLE SHEET MISFEEDS IN SHEET MEDIA FEED SYSTEMS

FIELD OF THE INVENTION

The present invention relates generally to paper or other sheet media feeding mechanisms and, more particularly, to a clearing mechanism for use with a sheet media feeding system to automatically clear the leading edges of the next-to-top sheets from the feed zone back toward the input tray to avoid multiple sheet misfeeds.

BACKGROUND OF THE INVENTION

Multiple sheet misfeeds are a common problem associated with sheet media feeding systems used with printers, copiers and the like. As the top sheet is "picked" from the stack of sheet media in the input tray, the next-to-top sheet, or top few sheets, are sometimes drawn partially into the feed mechanism by frictional forces between the top "fed" sheet and those beneath it. If these sheets are not cleared from the feed zone, then multiple sheets are likely to be drawn fully into the feed zone during the next pick cycle, resulting in a misfeed. One mechanism for reducing misfeeds is described in U.S. Pat. No. 5,269,506 entitled "Paper Pick-up System for Printers", issued Dec. 14, 1993 to Olson et al. and subject to common ownership herewith. The system described therein includes a pivotally operable, spring returnable separator located adjacent to and beneath the infeed rollers of the sheet pick mechanism. The separator has a frictionally adherent pad that opposes advancement of a next-to-top sheet in the infeed paper stack while the top sheet of the stack is pulled thereacross by one or more rollers. Although such a separator pad may be effective in opposing advancement of a next-to-top sheet fully into the feed zone, there typically remains undesirable advancement of the sheets below the top sheet partially into the feed zone. In addition, next-to-top sheets must be cleared from the separator pad so that a sufficient frictional area of the pad remains exposed for separation during the next pick/feed cycle.

Another mechanism for reducing multiple sheet misfeeds is disclosed in U.S. Pat. No. 5,316,285, issued to Olson et al. on May 31, 1994, and subject to common ownership herewith. Described therein is a realignment lever located adjacent to and beneath the sheet feeding rollers. At the beginning of the sheet feeding cycle, the realignment lever is moved out of the feed zone. After the top sheet is picked and passes by the lever, the lever is urged by spring force through the feed zone toward its rest position against the leading edge of the stack of sheets in the input tray. As the lever moves through the feed zone, it urges away from the feed zone any sheets that may have been partly advanced toward the feed zone. Under some conditions, such as a high angle input tray, a high humidity operating environment or lightweight sheet media, and particularly for those feed systems that utilize a frictionally adherent separation pad, the media will resist the return force and thereby increase the number of multiple sheet misfeeds. Increasing the return spring force can damage the leading edge of some sheet media and allows postcard type media to jump up and down in the input tray.

SUMMARY OF THE INVENTION

Accordingly, it is one object of the invention to automatically clear any next-to-top sheets that may be inadvertently drawn partially into the feed zone.

It is another object of the invention to automatically clear next-to-top sheets from the separator pad so that a sufficient frictional area of the pad remains exposed for separation during subsequent pick/feed cycles.

It is another object of the invention to consistently clear next-to-top sheets from the feed zone under a wide range of operating conditions, including those involving a high angle input tray, a high humidity environment or lightweight sheet media, without damaging the sheet media.

These and other objects and advantages are achieved by the invented clearing mechanism which may be used in stacked sheet media feeding systems of the type having a single sheet pick/feed mechanism for feeding a single sheet from the top of a sheet media stack. The clearing mechanism includes a "kick" lever positioned adjacent and somewhat below a sheet pick roller. At the beginning of the sheet feeding cycle, the lever is moved by a cam/follower from an obstructing position within the feed zone adjacent to the leading edge of the media stack to a non-obstructing position free of the feed zone for unobstructed feeding of the top sheet. After the leading edge of the top sheet clears the lever, the lever is urged by a spring force back toward the obstructing position. If the lever does not return to the obstructing position at the urging of the spring force, then, upon rotation of the pick/feed mechanism into a pre-sheet feeding orientation, a second cam/follower moves the lever into the obstructing position, thereby clearing any next-to-top sheets that may have inadvertently advanced partially into the feed zone.

In one version of the claimed invention, the clearing mechanism includes a first member and a control mechanism. The first member is controllably moveable between a first non-obstructing position free of the feed zone for unobstructed feeding of a top sheet therethrough and a second obstructing position within the feed zone adjacent to the leading edge of the media stack. The control mechanism operates synchronously with the pick/feed mechanism to move the first member from the first position to the second position after the top sheet is picked from the stack, thereby clearing next-to-top sheets from the feed zone. The control mechanism includes (i) a recoil mechanism that selectively engages the first member to move the first member into the first position, (ii) a return mechanism that urges the first member toward the second position, and (iii) a kicker mechanism that selectively engages the first member to move the first member into the second position if the first member has not theretofore been returned to the second position by the return mechanism.

In another version of the claimed invention, the clearing mechanism includes radially extending first and second cams rotatably disposed along the central axis of a cylinder defined by the feed roller of the pick/feed mechanism. First and second cam followers are laterally aligned with the first and second cams, respectively, for selective engagement with the cams at various predefined rotational orientations of the cams. A lever is pivotally coupled to the printer's chassis and fixedly connected to the cam followers. The distal end of the lever extends into the feed zone in a position obstructing the leading edges of the sheets in the media stack. The lever is moved by the first cam follower, upon rotation of the pick/feed mechanism into a first sheet feeding orientation wherein the first cam temporarily engages the first cam follower, through the feed zone into a non-obstructing position that permits feeding the top sheet of the media stack. A return mechanism, active when the feed roller is in a second predefined rotational orientation, continuously urges the distal end of the lever toward the obstructing position after the leading edge of the top sheet has been fed by the pick/feed mechanism downstream past the distal end of the lever. If the lever does not return to the obstructing position at the urging of the return mechanism, then, upon rotation of the drive mechanism into a pre-sheet feeding orientation, the second cam temporarily engages the second cam follower to move the lever into the obstructing position, thereby clearing next-to-top sheets from the feed zone.

The clearing mechanism of the invention, wherein a kicker mechanism moves the "kick" lever into the obstructing position if the return mechanism fails to do so, helps assure that next-to-top sheets are consistently cleared from the feed zone under a wide range operating conditions, including those involving a high angle input tray, a high humidity environment or light-weight sheet media, without damaging the sheet media. Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
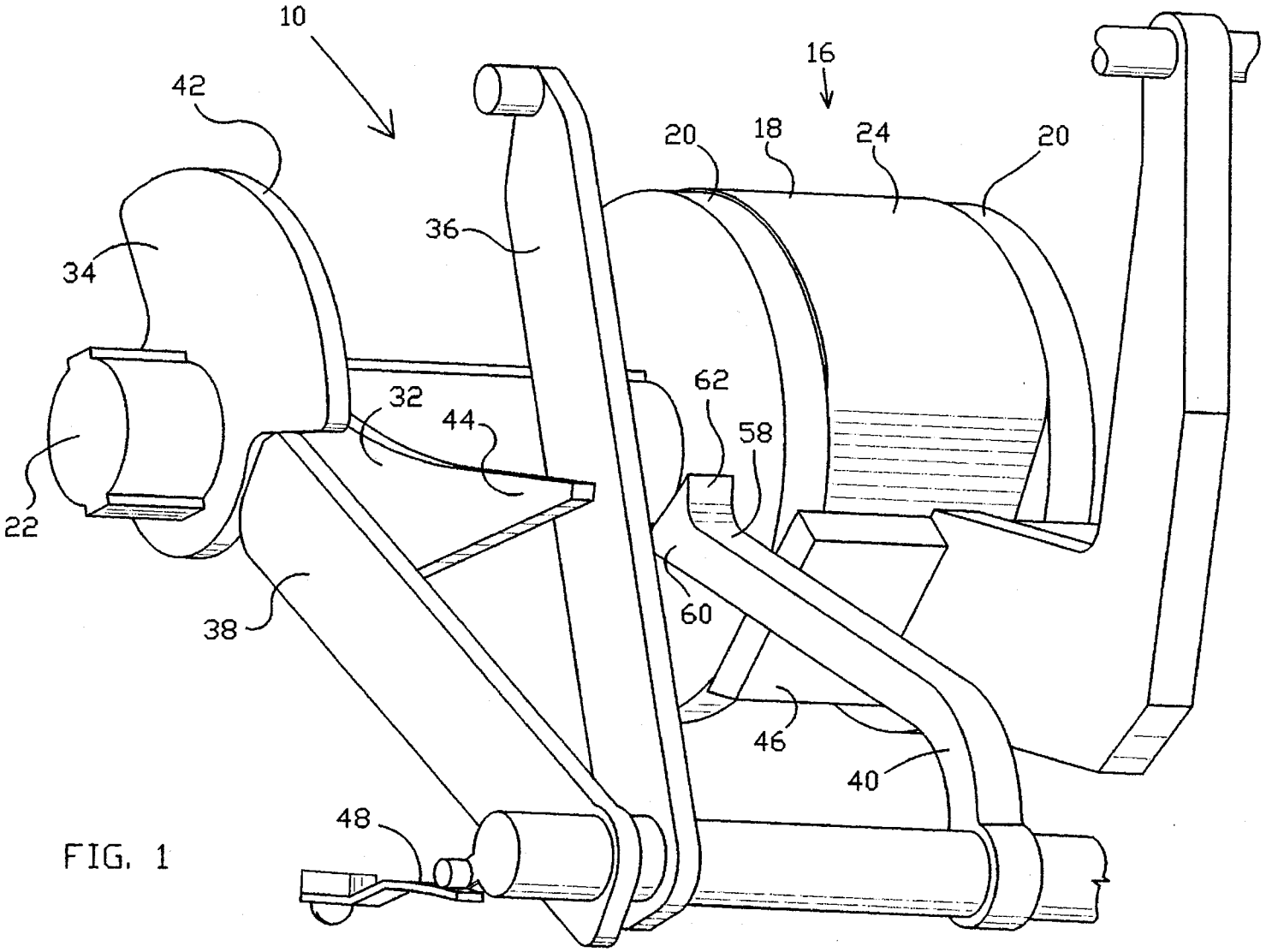
FIG. 1 is a perspective view illustrating the pertinent components of a printer paper feed system incorporating the invented clearing mechanism.
Figure 2:
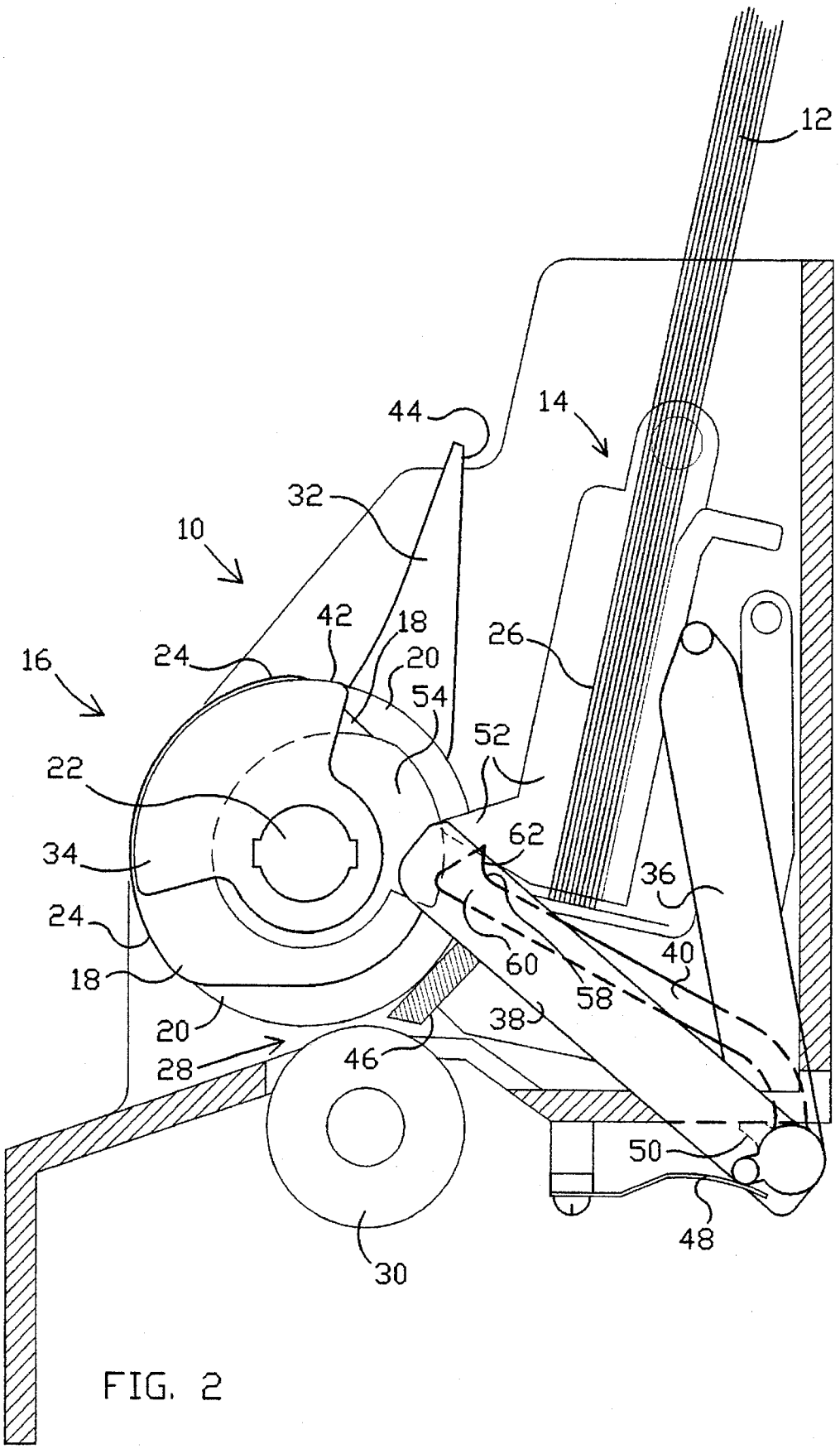
FIG. 2 is a fragmentary, sectional side elevation view showing the clearing mechanism in its nominal rest position immediately adjacent to the leading edge of the paper stack, before the printer has received a print command.
Figure 3:
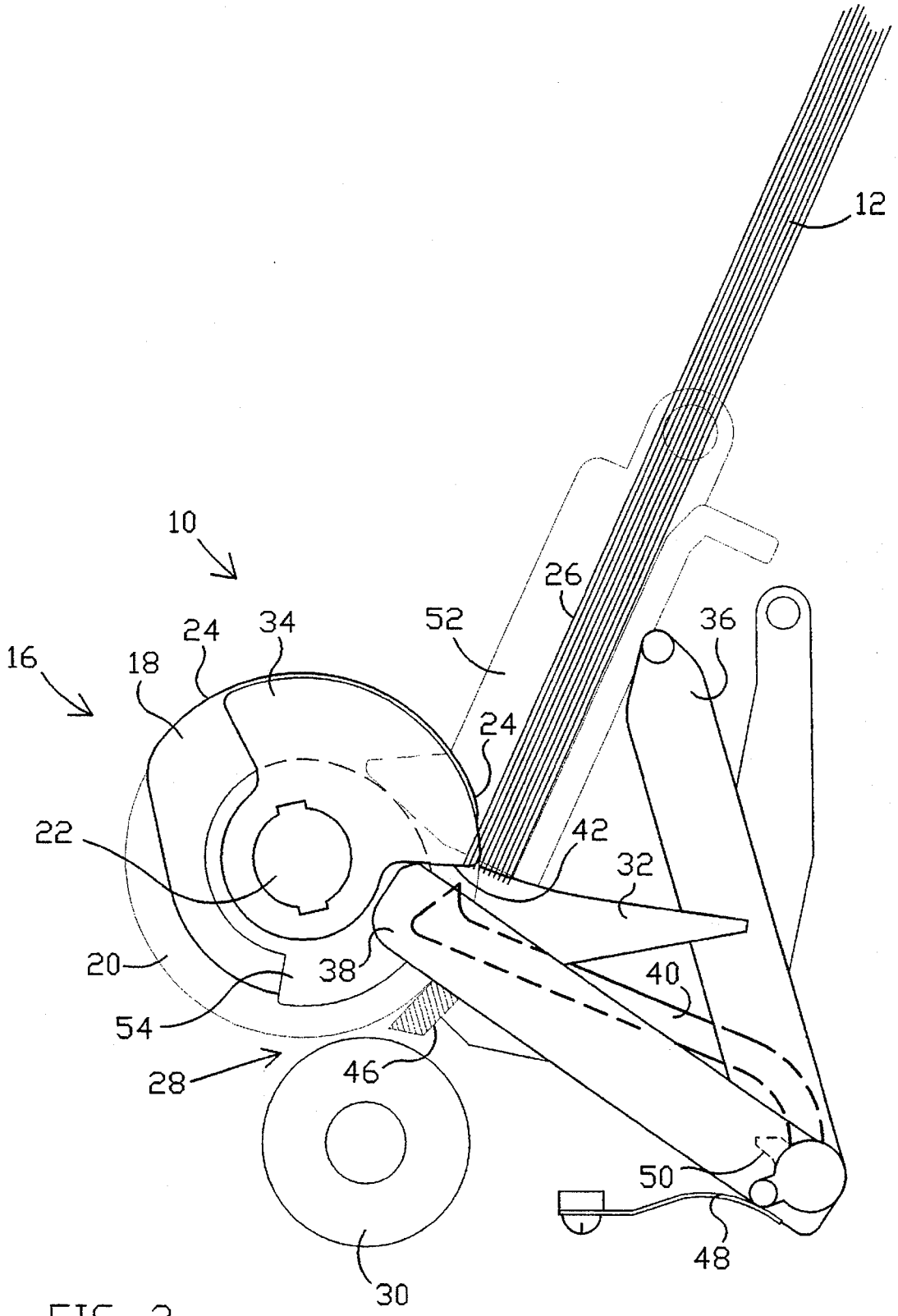
FIG. 3 is a view of the clearing mechanism similar to that of FIG. 2, showing a first phase of operation wherein the printer has received a pick command and the sheet pick roller begins to engage or "pick" the top sheet for printing.

The clearing mechanism of the present invention will be described for use in a printer having a high angle input tray to illustrate the preferred embodiment of the invention. The invention, however, is applicable more broadly to many types of printers, copiers, and similar equipment in which individual sheets are picked from a media stack for further downstream processing. FIG. 1 is a perspective view illustrating the pertinent components of a printer paper feed system incorporating the clearing mechanism of the present invention. FIG. 2 is a fragmentary, sectional side elevation view showing the clearing mechanism in its nominal rest position, before the printer has received a pick command. In order to better illustrate the novel features of the invention, the paper stack and input tray, which are common to many types of feed systems, are omitted from FIG. 1.

Referring to FIGS. 1 and 2, the clearing mechanism is indicated generally by reference number 10. Paper stack 12 is located in input tray 14. A rotatable sheet pick/feed mechanism 16 includes sheet pick roller 18, idler rollers 20 and feed roller 30. "Rotatable mechanism" is used broadly herein to mean any belt or gear driven sheet pick/feed mechanism or other suitable sheet medium advancing means. Sheet pick roller 18 is mounted on and operatively coupled to shaft 22 for rotation therewith. Sheet pick roller 18 includes an expanse 24 of frictional material over a portion of its outer surface. During a paper pick/feed cycle, frictional expanse 24 of sheet pick roller 18 engages the upper surface of top sheet 26 and advances top sheet 26 into feed zone 28. Idler rollers 20 are mounted on shaft 22 laterally adjacent to sheet pick roller 18. Feed roller 30, which is typically positioned beneath and immediately adjacent to one of the idler rollers 20, continues to advance top sheet 26 through feed zone 28 after top sheet 26 is released from frictional expanse 24 of sheet pick roller 18. Idler rollers 20 spin freely about shaft 22.

Kicker cam 32 and recoil cam 34 are mounted on shaft 22 lateral to sheet pick roller 18. Kicker cam 32 and recoil cam 34 are operatively coupled to shaft 22 for rotation therewith. Kicker cam follower 36, recoil cam follower 38 and "kick" lever 40 are pivotally mounted to the printer chassis or other suitable structural member. Lever 40 is fixedly connected to kicker cam follower 36 and recoil cam follower 38. In operation, described in more detail below, lobe 42 of recoil cam 34 engages recoil cam follower 38 to rotate lever 40 from its rest position out of the paper path as sheet pick roller 18 begins to engage top sheet 26. Lobe 42 of recoil cam 34 extends at a predefined angle that is advanced slightly relative to frictional expanse 24 of sheet pick roller 18 so that lever 40 leads the leading edge of top sheet 26 by a few degrees as top sheet 26 is picked and fed into feed zone 28. Lobe 44 of kicker cam 32 engages kicker cam follower 36 to move lever 40 back into a position adjacent to the stack, if necessary, at the beginning of a pick/feed cycle. Lobe 44 of kicker cam 32 extends at a predefined angle that is advanced slightly relative to lobe 42 of recoil cam 34 so that kicker cam follower 36 is engaged by the kicker cam 32 prior to the engagement of recoil follower by recoil cam 34. Shaft 22 is rotatably driven by a driver such as stepper motor (not shown). Pick/feed mechanism 16, including sheet pick roller 18, feed roller 30, idler rollers 20, and the driver are conventional and may be implemented in any suitable manner well known to those skilled in the art.

Lever 40 is pivotable in an arc that sweeps through a fraction of a cylindrical volume defined by sheet pick roller 18. Separator pad 46 is located closely adjacent to and beneath sheet pick roller 18. Lever 40 is preferably located laterally adjacent to separator pad 46. Lever 40 is coupled to the chassis or other suitable structure at its pivotal axis for pivotal movement through an arc limited by its extreme rearward position, representing a nominal rest position in which lever 40 normally is maintained, preferably by spring 48. Preferably, lever 40 is prevented from moving clockwise beyond this rearward position by stop 50. As described in more detail below, spring 48 serves as a return mechanism to urge lever 40 from its forward non-obstructing position 66 toward its rearward obstructing position 68. Spring 48 may be a chassis mounted beam spring 48 such as that described in U.S. Pat. No. 5,316,285, issued to Olson et al. on May 31, 1994, col. 4, LL. 1–32, incorporated herein by reference, or other suitable return mechanism impacting on lever 40.

Operation of the clearing mechanism 10 is illustrated FIGS. 3–8 as part of a printer feed system using a high angle input tray 14. To facilitate convenient operation of the system, the paper stack 12 is moveable in and out of the feed position by means of a cooperating lift plate 52 and lift plate cam 54. Lift plate 52 and lift plate cam 54 are not part of the invented clearing mechanism 10, but are shown to better illustrate one application of the preferred embodiment of the invention. In a first phase of operation shown in FIG. 3, wherein the printer has received a pick command, shaft 22 begins to rotate to release lift plate 52 from lift plate cam 54 to bring paper stack 12 into position for the pick. Lobe 42 of recoil cam 34 engages recoil cam follower 38 to rotate lever 40 out of the paper path as sheet pick roller 18 begins to engage top sheet 26. Lobe 42 of recoil cam 34 extends at a predefined angle that is advanced slightly relative to the frictional expanse 24 of pick roller 18 and retarded slightly relative to lobe 64 of lift plate cam 54 so that lever 40 leads the leading edge of the top sheet 26 by a few degrees.

Figure 4:
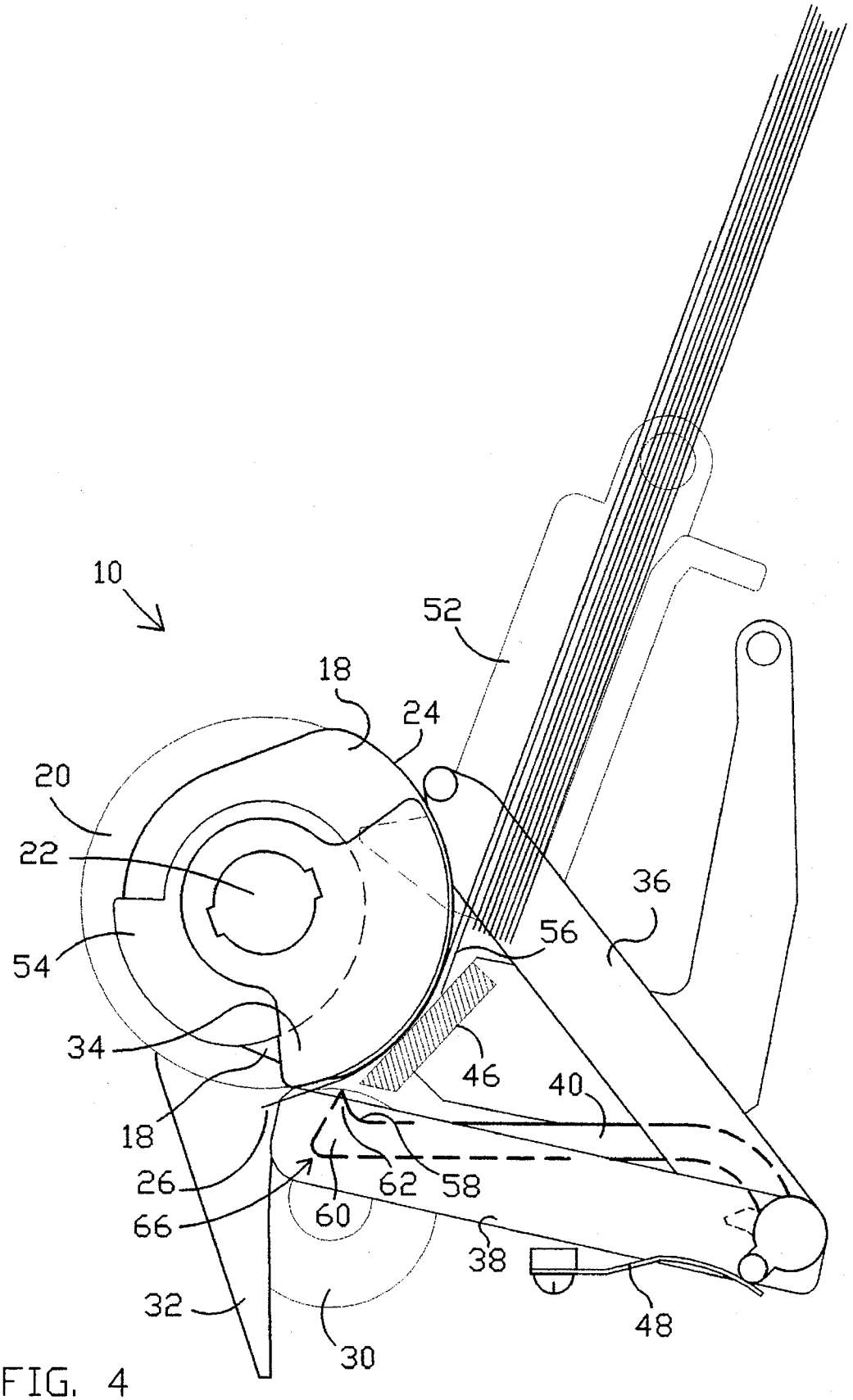
FIG. 4 is a view of the clearing mechanism similar to that of FIGS. 2 and 3, showing a second phase of operation wherein the top sheet is advanced further downstream into the feed zone and the kick lever is moved to a non-obstructing position allowing unobstructed feeding of the top sheet through the feed zone.

Turning next to FIG. 4, which illustrates a second phase of operation of the clearing mechanism 10, top sheet 26 is advanced downstream into feed zone 28 by engagement of its leading edge by frictional expanse 24 of sheet pick roller 18. Recoil cam 34 and recoil cam follower 38 have now moved lever 40 to a non-obstructing position 66 to allow unobstructed feeding of the top sheet 26 through feed zone 28. A next-to-top sheet 56 is shown dislodged from paper stack 12 and advanced somewhat downstream toward feed zone 28 due to frictional forces between adjacent sheets. Sheet 56 is intended to represent one or more next-to-top sheets that may be advanced partially into the feed zone. Although this advancement may not result immediately in a multiple sheet misfeed because of the advancement retarding effect of separator pad 46, such advancement is often cumulative through successive feed cycles. The separator pad must be cleared to provide sufficient frictional pad area for separation during succeeding pick/feed cycles. The preferred structure of lever 40 includes a sheet confronting expanse 58 adjacent to distal end 60. Expanse 58 preferably confronts the leading edges of the paper at an approximately right angle to minimize damage to the paper as it is cleared from the fee zone and returned toward leading edge realignment in the stack. Distal end 60 of lever 40 preferably terminates in a hook shaped extremity 62.

Figure 5:
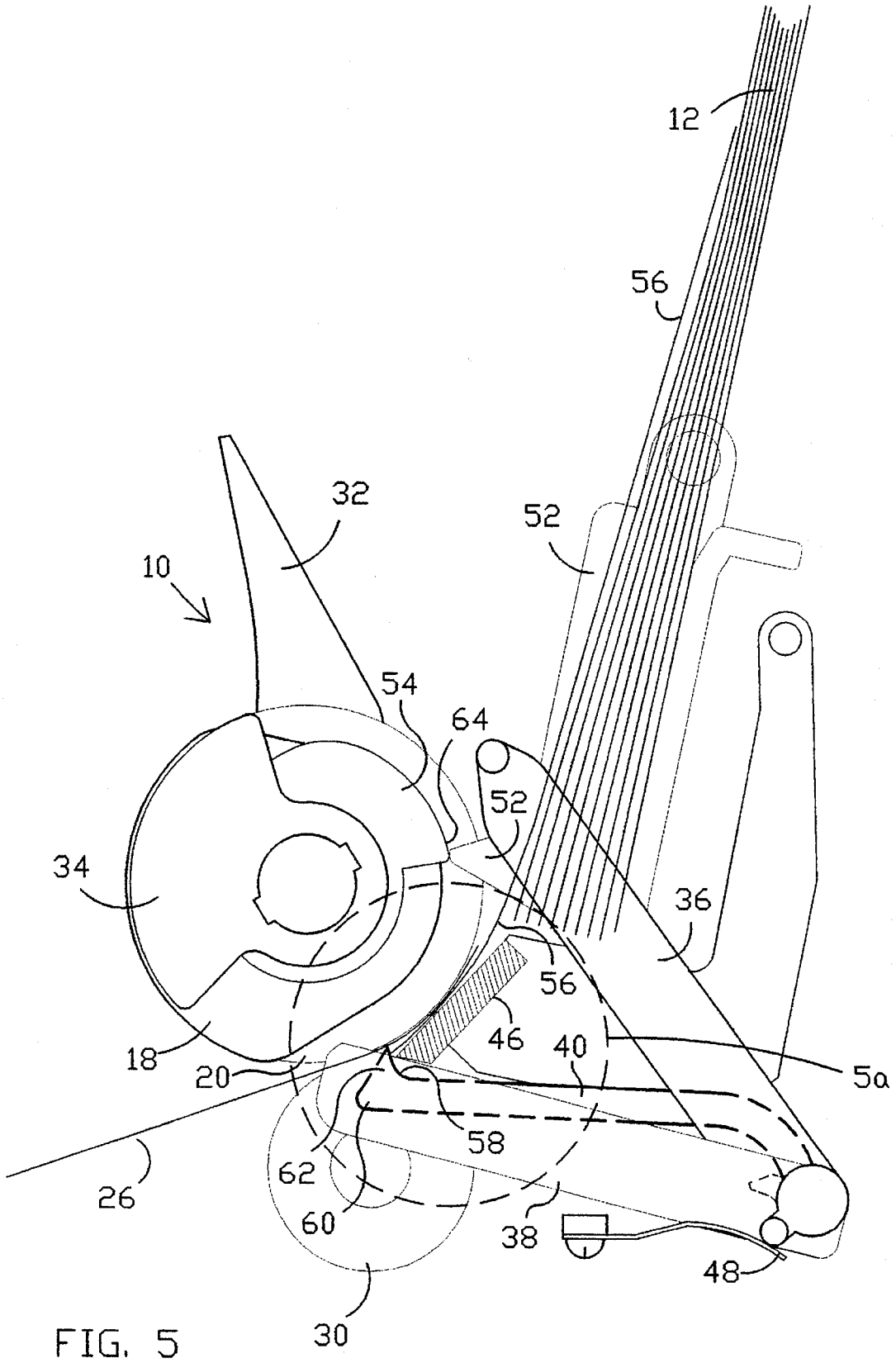
FIG. 5 is a view of the clearing mechanism similar to that of FIGS. 2–4, showing a third phase of operation wherein the hooked distal end of the kick lever is released to ride along the bottom surface of the advancing top sheet to restrain the advancement of next-to-top sheets that may have been drawn partially into the feed zone.

In a third phase of operation shown in FIG. 5, recoil cam follower 38 is released from lobe 42 of recoil cam 34 after the leading edge of top sheet 26 advances past distal end 60 of lever 40, thus allowing hook 62 to ride along the bottom surface of the top sheet 26 at the urging of spring 48. Hook 62 thus restrains the further advancement of next-to-top sheet 56. Hook also serves to guide the leading edge of next-to-top sheet 56 into confronting expanse 58 to minimize damage to the leading edge as next-to-top sheet 56 is cleared from the feed zone.

Figure 6:
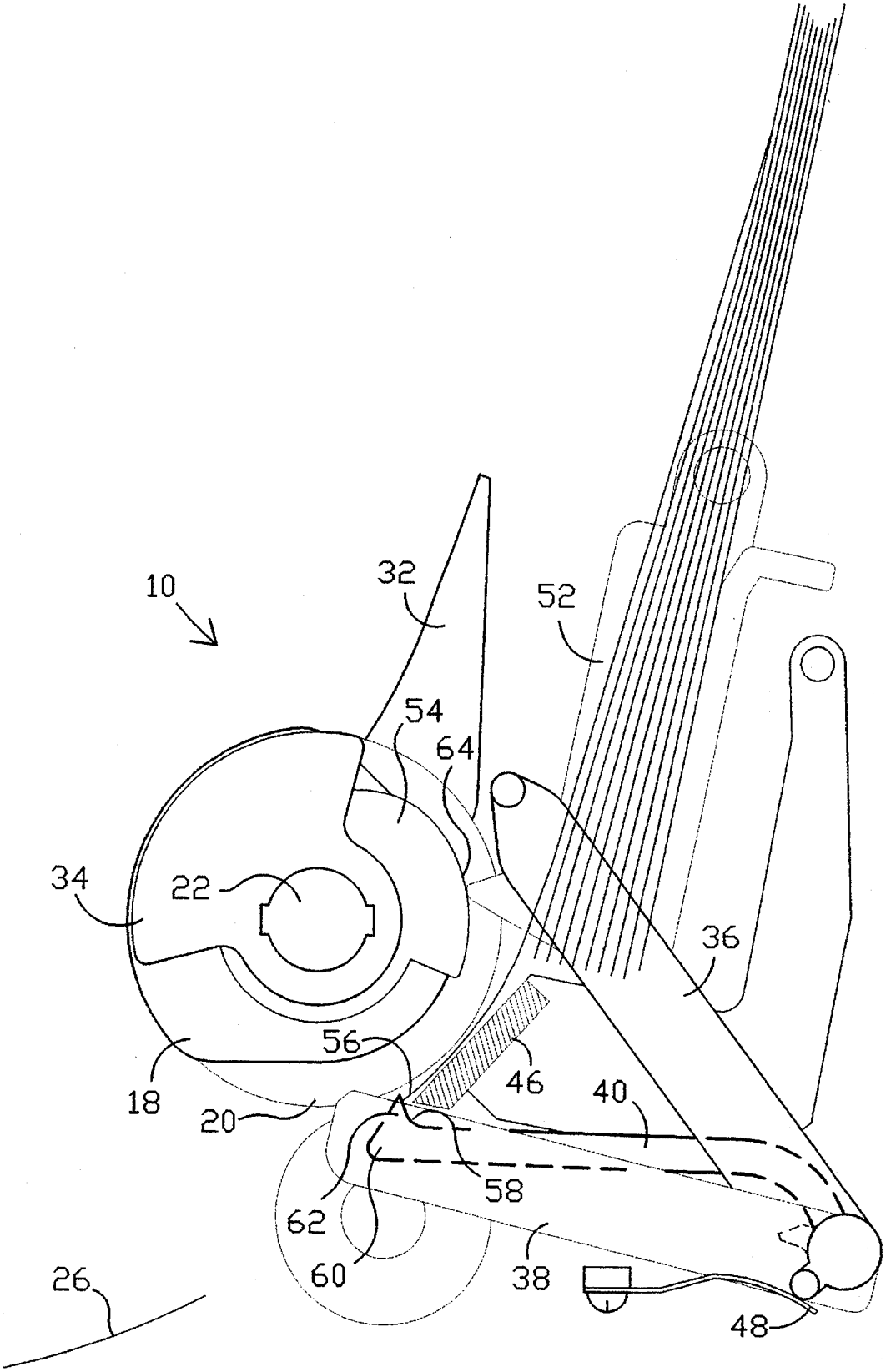
FIG. 6 is a view of the clearing mechanism similar to that of FIGS. 2–5, showing a fourth phase of operation wherein the pick/feed mechanism has completed the first feed cycle.
Figure 7:
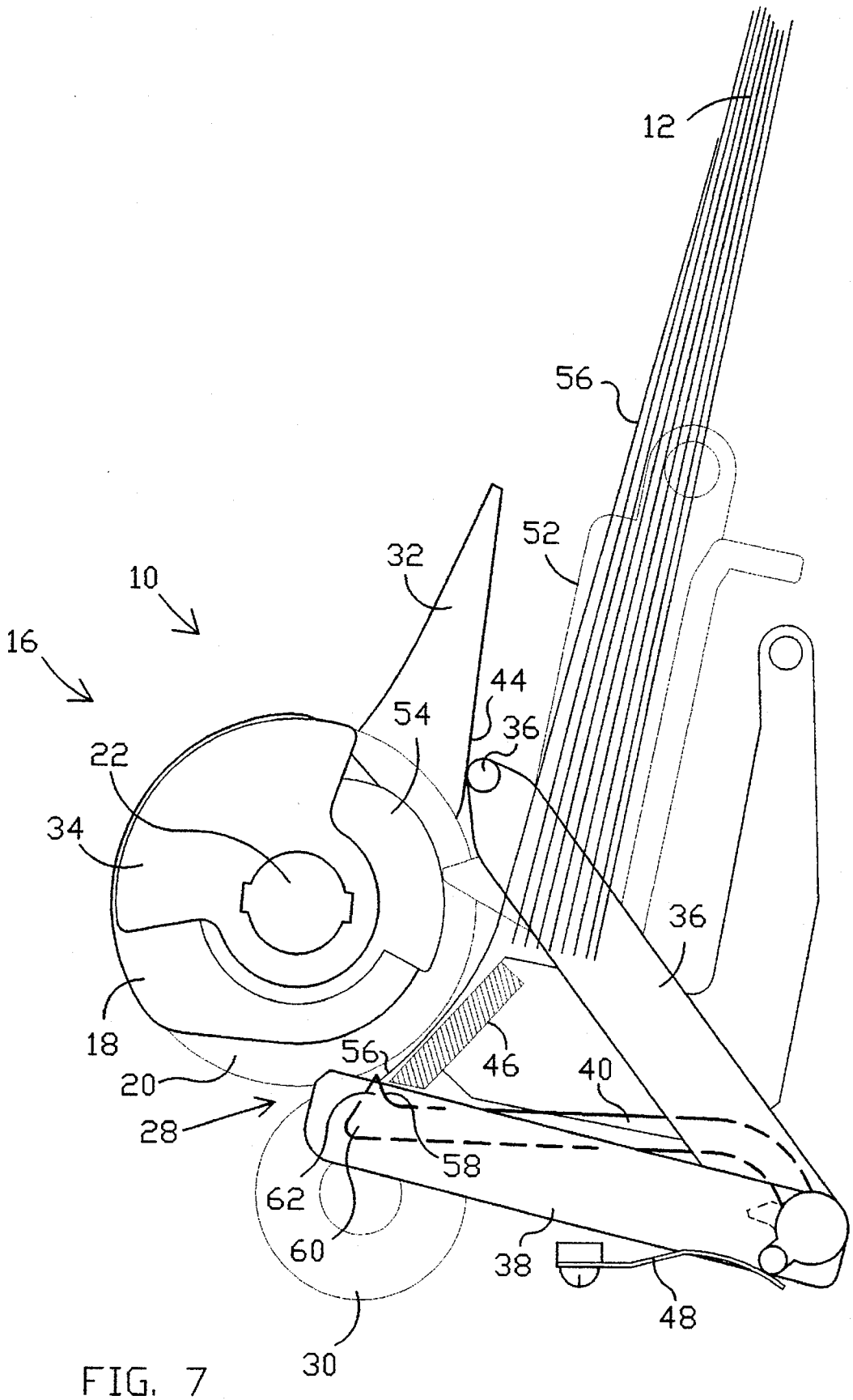
FIGS. 7 and 8 are views of the clearing mechanism similar to FIGS. 2–6, showing a final phase of operation wherein the printer has received a second pick command and the kick lever is moved into the obstructing position adjacent to the leading edge of the paper stack.
Figure 8:
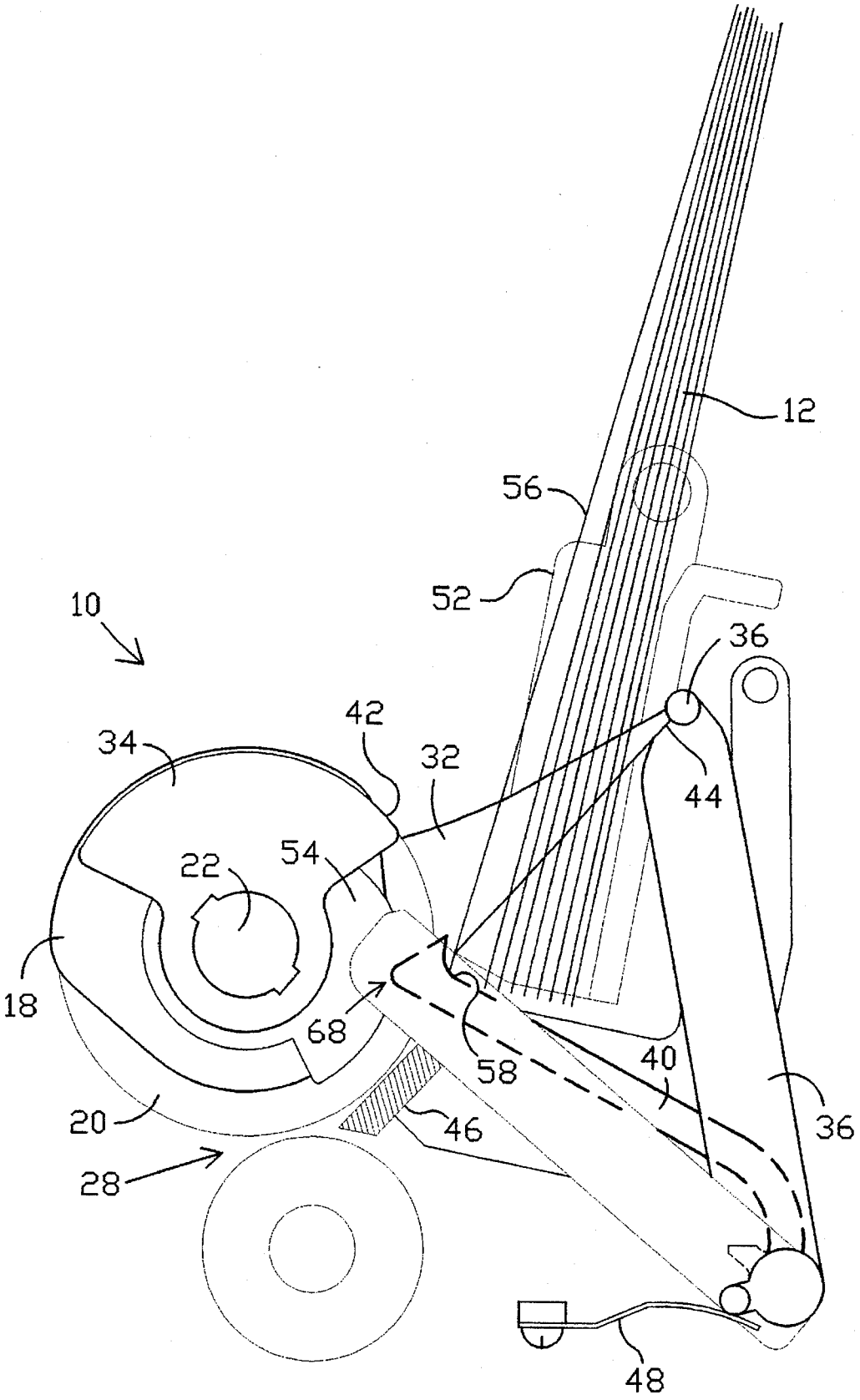

Referring to FIG. 6, shaft 22 has now completed one rotation. Lobe 64 of lift plate cam 54 has engaged lift plate 52 to move the stack out of the feed position. If the urging of return spring 48 is not sufficient to clear next-to-top-sheet 56 from the feed zone, as shown in FIG. 6, then the invented clearing mechanism 10 operates in a fourth phase upon initiation of the next pick command. Referring now to FIGS. 7 and 8, the printer has received a second pick command, shaft 22 begins to rotate to release lift plate 52 from the lift plate cam 54 to bring the paper stack 12 into position for the pick. Simultaneously therewith, lobe 44 of kicker cam 32 engages kicker cam follower 36 to move lever 40 into obstructing position 68 thereby clearing next-to-top sheet 56 from feed zone 28. Thus, the clearing mechanism 10 is moved through it final phase of motion to clear the paper path for the feed cycle. Thereafter, the kicker cam follower 36 is released from lobe 44 of kicker cam 32 as lift plate 52 is fully released from lobe 64 of lift plate cam 54 and the feed cycle continues as previously described. Lobe 44 of kicker cam 32 extends at a predefined angle that is advanced slightly relative to lobe 42 of recoil cam 34 and retarded slightly relative to the leading surface of lobe 64 of lift plate cam 54 so that kicker cam follower 36 is engaged, and lever 40 moves through it final phase, prior to the engagement of recoil cam follower 38 by recoil cam 34 and as lift plate 52 is released from lift plate cam 54.

In the event lever 40 is returned to obstructing position 68 adjacent to the stack upon the urging of return spring 48, then, correspondingly, kicker cam follower 36 will be moved beyond the reach of lobe 44 of kicker cam 32 (as shown in FIG. 2). Thus, kicker cam follower 36 will only be engaged if next-to-top sheet 56 has not been cleared from the feed zone upon initiation of the next pick command. In the preferred embodiment described above, kicker cam 32 is shown to engage kicker cam follower 36 upon the initiation of a second pick command. However, lever 40 may be caused to move through its final phase of motion, as may be desireable or necessary for various types of feed systems, at any stage in the rotation of shaft 22. Other cam/follower configurations or similar suitable mechanisms may also be used.

The invented clearing mechanism is useful in any stacked sheet feeding equipment that includes a single sheet pick/feed mechanism for feeding a single sheet from the top of a sheet media stack through a feed zone. In this context, the clearing mechanism includes a first member, e.g. lever 40, adjacent to the pick/feed mechanism and controllably moveable between a first non-obstructing position free of the feed zone (refer to FIG. 4) for unobstructed feeding of a top sheet therethrough and a second obstructing position within the feed zone adjacent to the leading edge of the media stack (refer to FIG. 8). Such first member preferably includes a sheet media confronting expanse, e.g. expanse 58, for guiding next-to-top sheets upstream toward leading edge alignment with the remaining sheets in the stack. The clearing mechanism also includes a control mechanism operable synchronously with the pick/feed mechanism to move the first member from the first position to the second position after feeding a single sheet, thereby clearing next-to-top sheets from the feed zone. The control mechanism comprises a recoil mechanism for selectively engaging the first member to move the first member into the first position, a return mechanism for urging the first member toward the second position, and a kicker mechanism for selectively engaging the first member to move the first member into the second position if the lever member has not theretofore been returned to the second position by the return mechanism. This claimed control mechanism will be understood by those skilled in the art to be implemented in the preferred embodiment by recoil cam 34 and recoil cam follower 38 (the recoil mechanism) for moving lever 40 into the first position, the return spring 48 (the return mechanism) for urging lever 40 toward the second position, and kicker cam 32 and kicker cam follower 36 (the kicker mechanism) for moving lever 40 into the second position.

The invented sheet media clearing mechanism will also be understood to include first and second cams, e.g. recoil cam 34 and kicker cam 32, operatively coupled to the pick/feed mechanism. First and second cam followers, e.g. recoil cam follower 38 and kicker cam follower 36, are selectively engaged by the first and second cams at various predefined rotational orientations of the cams. A preferably pivotal lever, e.g. lever 40, is operatively coupled to the first and second cam followers and extends into and nominally traverses the feed zone, as best shown by comparing FIGS. 3 through 8. The lever preferably is dimensioned and oriented such that its distal end pivots in an arc that sweeps a fractional volume of a cylinder defined by the full rotation of a sheet feeding roller. The first cam temporarily engages the first cam follower, upon rotation of the pick/feed mechanism into a sheet feeding orientation, to move the lever through the feed zone into a non-obstructing position that permits feeding the top sheet of the media stack into the feed zone. A return mechanism operatively coupled to the lever continuously urges the lever toward the obstructing position. If the lever does not return to the obstructing position at the urging of the return mechanism, then upon rotation of pick/feed mechanism into a pre-sheet feeding position, the second cam temporarily engages the second cam follower to move the lever into the obstructing position thereby clearing next-to-top sheets from the feed zone.

While the present invention has been shown and described with reference to the foregoing preferred embodiment, it will be apparent to those skilled in the art that other forms and details may be made thereto without departing from the spirit and scope of the invention as defined in the appended claims.

What is claimed is:

1. A clearing mechanism for avoiding multiple sheet misfeeds in stacked sheet media feeding systems of the type having a single sheet pick/feed mechanism for feeding a single sheet from the top of a sheet media stack, the clearing mechanism comprising:

a. a first member controllably moveable between a first non-obstructing position free of a feed zone for unobstructed feeding of a top sheet therethrough and a second obstructing position within the feed zone adjacent to the leading edge of the media stack;

b. a control mechanism operable synchronously with the pick/feed mechanism to move the first member from the first position to the second position after feeding a single sheet, thereby clearing next-to-top sheets from the feed zone; and c. the control mechanism comprising (i) a recoil mechanism for selectively engaging the first member to move the first member into the first position, (ii) a return mechanism for urging the first member toward the second position after a leading edge of the top sheet has been fed downstream past the first member, and (iii) a kicker mechanism for selectively engaging the first member to move the first member into the second position.

2. A mechanism according to claim 1, wherein the first member is positioned laterally adjacent to the pick/feed mechanism.

3. A mechanism according to claim 1, wherein the first member is moved pivotally by the control mechanism between the first and second positions.

4. A mechanism according to claim 1, wherein the first member includes a distal end having a sheet media confronting expanse thereon for guiding next-to-top sheets in the stack upstream out of the feed zone.

5. A mechanism according to claim 1, wherein the return mechanism comprises a spring impacting on the first member.

6. A mechanism according to claim 4, wherein the recoil mechanism releases the first member after the leading edge of the top sheet has been fed past the distal end of the first member.

7. A mechanism according to claim 6, wherein the distal end of the first member terminates in a hook shaped extremity, the hook shaped extremity being adapted to ride along a bottom surface of the top sheet after the recoil mechanism releases the first member and, at the urging of the return mechanism, to restrain the further advancement of any next-to-top sheets that may have advanced partially into the feed zone.

8. A clearing mechanism for avoiding multiple sheet misfeeds in stacked sheet media feeding systems, the clearing mechanism comprising:

a. a rotatable sheet pick/feed mechanism defining adjacent thereto a single sheet media feed zone;

b. first and second cams operatively coupled to the pick/feed mechanism for rotation therewith;

c. first and second cam followers that are selectively engaged by the first and second cams, respectively, at various predefined rotational orientations of the cams;

d. a pivotal lever operatively coupled to the first and second cam followers and extending into the feed zone in a position obstructing the leading edges of the sheets in the media stack;

e. the first cam temporarily engaging the first cam follower, upon rotation of the pick/feed mechanism into a sheet feeding orientation, to move the lever into a non-obstructing position that permits feeding the top sheet of the media stack through the feed zone;

f. a return mechanism operatively coupled to the lever for continuously urging the lever toward the obstructing position; and g. the second cam operable, upon rotation of the drive mechanism into a pre-sheet feeding orientation, to temporarily engage the second cam follower to move the lever into the obstructing position.

9. A mechanism according to claim 8, further comprising a drive mechanism for rotating the pick/feed mechanism and the cams operatively coupled thereto into various predefined rotational orientations.

10. A mechanism according to claim 8, wherein the lever includes a distal end having a sheet media confronting expanse thereon for guiding next-to-top sheets in the stack upstream out of the feed zone.

11. A mechanism according to claim 10, wherein the distal end of the lever terminates in a hook shaped extremity, the hook shaped extremity being adapted to ride along a bottom surface of the top sheet after the first cam releases the first cam follower and, at the urging of the return mechanism, to restrain the further advancement of any next-to-top sheets that may have advanced partially into the feed zone.

12. A mechanism according to claim 11, wherein the first cam releases the first cam follower after the leading edge of the top/picked sheet clears the distal end of the lever, thereby allowing the hook shaped extremity to ride along the bottom surface of the top/picked sheet and restrain the further advancement of any next-to-top sheets that may have partially advanced into the feed zone.

13. A mechanism according to claim 8, further comprising a separator pad closely adjacent to the pick/feed mechanism, the separator pad having a friction promoting upper surface for opposing advancement of next-to-top sheets into the feed zone.

14. A mechanism according to claim 13, wherein the separator pad and the lever are disposed laterally adjacent to one another.

15. A mechanism according to claim 8, wherein the pick/feed mechanism includes at least one roller having a frictional expanse thereon for engaging the top sheet.

16. A mechanism according to claim 15, wherein the lever is dimensioned and oriented such that a distal end thereof pivots in an arc that sweeps a fractional volume nominally within a cylinder defined by the roller.

17. A mechanism according to claim 15, wherein the first and second cams extend radially outward normal to a central rotational axis of a cylinder defined by the rollers.

18. A mechanism according to claim 8, wherein, if the lever does not return to the obstructing position at the urging of the return mechanism, then the second cam temporarily engages the second cam follower to move the lever into the obstructing position.

19. A clearing mechanism for avoiding multiple sheet misfeeds in a stacked sheet media printer of the type having a single sheet pick/feed mechanism for feeding a single sheet from the top of a sheet media stack through a feed zone by rotation of one or more rollers defining a cylinder and selectively engaging the top sheet, the clearing mechanism comprising:

a. radially extending first and second cams rotatably disposed along a central axis of the cylinder;

b. first and second cam followers laterally aligned with the first and second cams, respectively, for selective engagement with the cams at various predefined rotational orientations of the cams;

c. a lever pivotally coupled to the printer's chassis and fixedly connected to the cam followers, the lever having a distal end extending into the feed zone in a position obstructing the leading edges of the sheets in the media stack, the lever being moved by the first cam follower, upon rotation of the pick/feed mechanism into a first sheet feeding orientation wherein the first cam temporarily engages the first cam follower, through the feed zone into a non-obstructing position that permits feeding the top sheet;

d. a return mechanism active when the rollers are in a second predefined rotational orientation to continuously urge the distal end of the lever toward the obstructing position after the leading edge of the top sheet has been fed downstream past the distal end of the lever; and e. the second cam operable, upon rotation of the drive mechanism into a pre-sheet feeding orientation, to temporarily engage the second cam follower to move the lever into the obstructing position.

20. A mechanism according to claim 19, wherein, if the lever does not return to the obstructing position at the urging of the return mechanism, then the second cam temporarily engages the second cam follower to move the lever into the obstructing position.

* * * * *